US005424925A

United States Patent [19]

Jenke et al.

[11] Patent Number: 5,424,925

[45] Date of Patent: Jun. 13, 1995

[54] DECORATIVE LIGHTING SYSTEM AND METHOD

[76] Inventors: Richard P. Jenke; Mary K. Jenke, both of 7246 La Sobrina, Dallas, Dallas County, Tex. 75248

[21] Appl. No.: 316,235

[22] Filed: Sep. 30, 1994

[51] Int. Cl.[6] ..... F21P 1/02

[52] U.S. Cl. ..... 362/123; 362/806; 362/252; 362/250; 362/103

[58] Field of Search ..... 362/123, 215, 234, 287, 362/806, 252, 103, 249, 250, 238, 239, 108; 439/505, 648, 640

[56] References Cited

U.S. PATENT DOCUMENTS

| | | | |
|---|---|---|---|
| 3,096,943 | 7/1963 | Forrer | 240/10 |
| 3,723,723 | 3/1973 | Lerner | 362/806 X |
| 4,404,621 | 9/1983 | Mauro | 362/419 |
| 4,620,270 | 10/1986 | Laakso | 362/123 |
| 4,720,773 | 1/1988 | Ahroni | 362/249 |
| 4,870,547 | 9/1989 | Crucefix | 362/123 |
| 5,019,438 | 5/1991 | Rapisarda | 362/103 X |
| 5,057,976 | 10/1991 | DuMong | 362/123 |
| 5,213,519 | 5/1993 | Dorfman | 439/505 |
| 5,245,519 | 9/1993 | Openiano | 362/252 |

*Primary Examiner*—James C. Yeung
*Assistant Examiner*—Thomas M. Sember
*Attorney, Agent, or Firm*—Baker & Botts

[57] ABSTRACT

A decorative lighting system (14, 50) includes a plurality of electrically conductive filaments (36) that emit visible electromagnetic radiation when an electric current is passed therebetween. First and second flexible insulated electrically conductive wires (16, 18) are electrically coupled at spaced intervals to first ends (37) and second ends (39) of the filaments (36) to form a parallel circuit between the conductive wires (16, 18). In one embodiment, the conductive wires (16, 18) form a substantially planar serpentine pattern by intersecting themselves at spaced crossing points (19). Connectors (34) are disposed at the crossing points (19) to provide an adjustable substantially planar web-like configuration (26). In another embodiment, netting (30) is provided of unitary construction formed by intersecting strands (28) of non-conductive flexible material. Fasteners (29) couple the netting (30) to the web-like configuration (26).

12 Claims, 3 Drawing Sheets

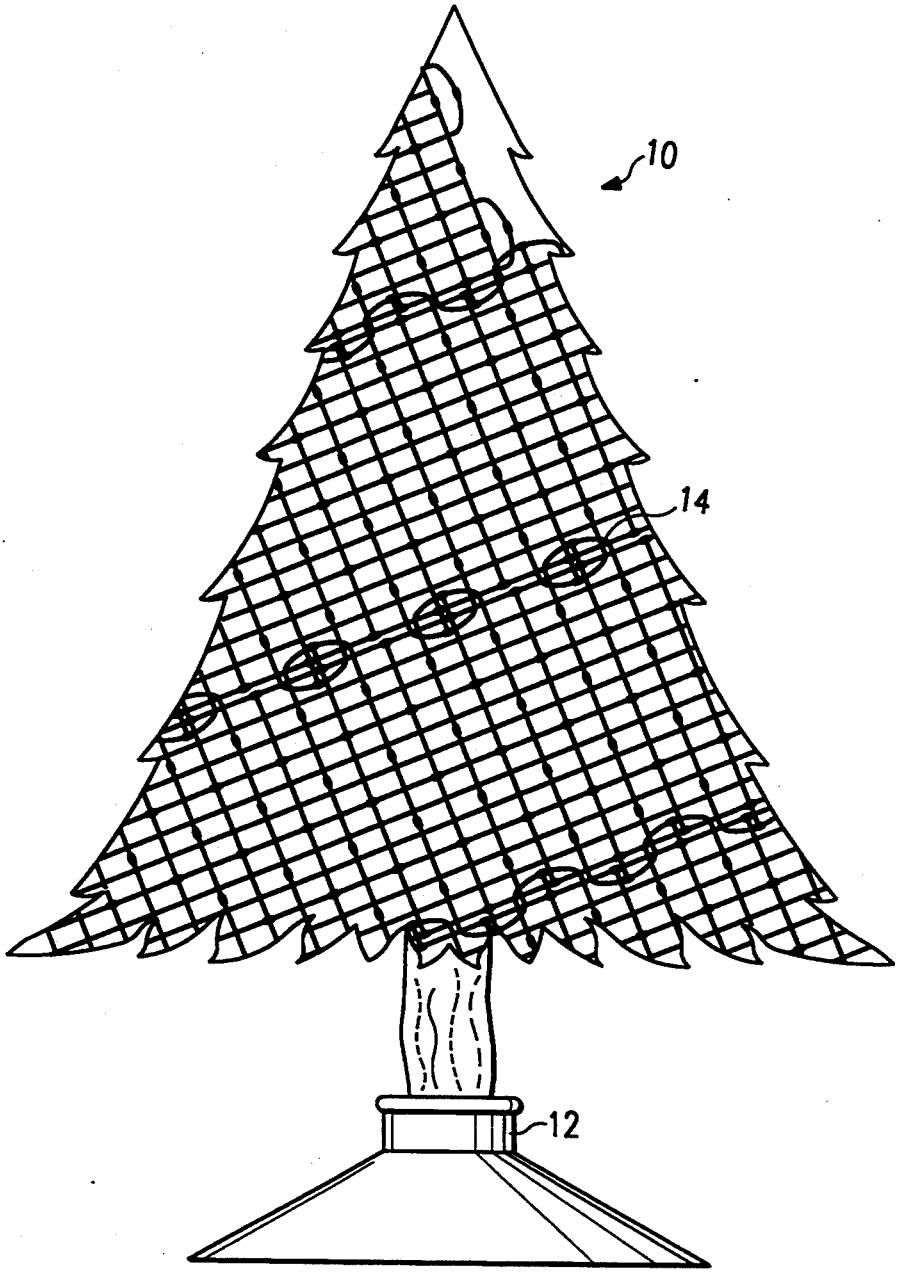
FIG. 1
FIG. 4
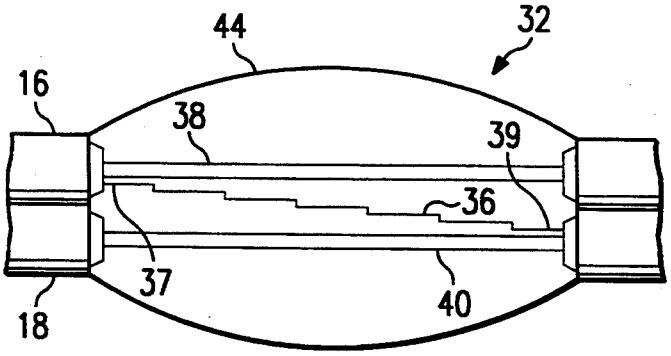

DECORATIVE LIGHTING SYSTEM AND METHOD

TECHNICAL FIELD OF THE INVENTION

This invention relates in general to the field of decorative displays, and more particularly to a decorative lighting system and method.

BACKGROUND OF The INVENTION

Conventional Christmas tree lighting systems commonly employ a plurality of electrical receptacles, each adapted to receive individual Christmas lights and mounted spatially along a pair of elongate insulated conductors. The conductors typically terminate at one end in an attachment suitable for connecting the system to a source of electricity and at another end in an individual Christmas light or in an attachment suitable for interconnecting multiple lighting systems. Such systems typically have the individual lights arranged in either a series or parallel connection, with the voltage and current ratings of the lights selected accordingly.

Christmas tree lights are typically placed about a Christmas tree by repeatedly winding a continuous string of lights over and between the tree branches. Applying and removing strings of lights is time consuming and burdensome. The process may result in broken branches, branches stripped of needles, partial destruction of the continuous wire to which the lights are attached, or injury to the person applying the light strings to the tree. These strings of lights are very difficult to apply in a uniform, balanced, or patterned distribution over the entire tree surface. In addition, these strings of lights are difficult to remove and store without severe tangling.

To facilitate the deployment of Christmas tree lights, U.S. Pat. No. 3,096,943 to Forrer describes the use of a non-adjustable grid-like lighting assembly consisting of interconnected light-bearing risers, which may be wrapped once around the circumference of a tree and fastened to assume a substantially frustro-conical form. Forrer cannot be adapted to a variety of tree sizes and shapes. U.S. Pat. No. 5,057,976 to DuMong describes a unitary assembly that may be wrapped once around the circumference of a tree and fastened to provide a substantially even light presentation over the portion of the tree surface actually covered by the assembly. Like Forrer, the system described in DuMong lacks adaptability to different sized trees. U.S. Pat. No. 5,213,519 to Dorfman describes a unitary assembly that may be draped over and around a tree but, like Forrer and DuMong, cannot present a particular spatial distribution of lights over the tree surface without regard to the size of the tree and the corresponding size and spatial distribution of its branches. Furthermore, prior art lighting systems, such as those described in Forrer, DuMong, and Dorfman, employ lighting elements that extend outward from the plane of the assembly, which exacerbates the tangling problem.

SUMMARY OF THE INVENTION

In accordance with the present invention, the disadvantages and problems associated with previously developed Christmas tree lighting systems have been substantially reduced. The present invention improves decorative and functional adaptability while reducing entanglement within the system by incorporating lighting elements into a substantially planar network of conductive and non-conductive members that may be configured so as to achieve virtually any desired lighting pattern and distribution.

In one aspect of the present invention, a decorative lighting system for arranging an array of electrical lighting elements is described. Electrically conductive filaments, having first and second ends, emit visible electromagnetic radiation when an electric current is passed between the first and second ends. Each electrical lighting element has at least one filament. A first flexible insulated electrically conductive continuous wire having first and second ends is electrically coupled at spaced intervals along its length to the first ends of the filaments. A second flexible insulated electrically conductive continuous wire having first and second ends is disposed adjacent the first conductive wire along its entire length. The second conductive wire is electrically coupled at spaced intervals along its length to the second ends of the filaments to form a parallel electrical circuit between the conductive wires. The first ends of the conductive wires are adapted to receive a potential from an electrical power source. Extending from their first ends, the first and second conductive wires form a substantially planar serpentine pattern by intersecting themselves at spaced crossing points. The conductive wires are adjustably connected to one another at the crossing points by connectors so as to provide an adjustable substantially planar web-like configuration.

More specifically, the present invention provides a lighting system with a netting of unitary construction formed by the intersection of strands of non-conductive flexible material. Fasteners couple the netting to the web-like configuration. The netting and web-like configuration may be substantially coextensive in coverage. The lighting system is substantially longer along a first axis than along a second axis perpendicular to the first axis. The resulting decorative lighting system is operable to removably and adjustably wrap around the circumference of a Christmas tree a plurality of times to provide a selected distribution of the electrical lighting elements.

Important technical advantages of the present invention can include providing a uniform or otherwise patterned light distribution that is easily adaptable according to the desires of a user. One embodiment of the present invention provides for adjustability in the spatial distribution of lights through the use of connectors at selected crossing points in the web-like configuration. Another embodiment provides for adjustability in the spatial distribution of lights through the use of fastening components by which the conductive wires may be arranged in a desired pattern and fixed to the netting. Both embodiments may also assume an elongated rectangular form which may be wrapped around the circumference of a tree or other object several times to provide further adjustability in the spatial distribution of lights.

Other important technical advantages of the present invention can include a decorative lighting system that covers the entire surface of a Christmas tree regardless of its size or the spatial distribution of its branches. The system may be wrapped around the circumference of a Christmas tree in ascending or descending coil fashion as many times as is necessary to cover the entire tree surface with the desired spatial distribution of lights. In addition, the system may be adaptably secured to trees having a low branch density through the use of interstitial netting.

Further important technical advantages of the present invention can include eliminating or substantially reducing entanglement during application, removal, and storage. In one embodiment, the netting and web-like configuration are coupled into a substantially planar system that is relatively free of projections. In another embodiment, the conductive wires are arranged in a desired pattern and affixed to a netting to form a substantially planar system. In both embodiments, the filament encasements may be formed to minimize projections out of the plane of the decorative lighting system, which reduces the prospects of tangling.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein:

FIG. 1 is a front elevational view of a Christmas tree supporting a decorative lighting system in accordance with one aspect of the present invention;

FIG. 4 is a cross sectional view of a low profile lighting element used in the decorative lighting system;

DETAILED DESCRIPTION OF THE INVENTION

Preferred embodiments of the present invention are illustrated in FIGS. 1–6, like numerals being used to refer to like and corresponding parts of the various drawings.

FIG. 1 shows a conventional Christmas tree 10 mounted on a stand 12. Christmas tree 10 is decorated with a decorative lighting system 14 in accordance with the present invention. It should be understood that the present invention relates generally to a system and method of arranging lighting elements which may be used in a wide variety of applications in addition to decorating Christmas tree 10 as shown in FIG. 1. For example, decorative lighting system 14 may also be used for outdoor lighting of trees and shrub, lighting of houses and other structures, and any other suitable application requiring an arrangement of lights.

Figure 2:
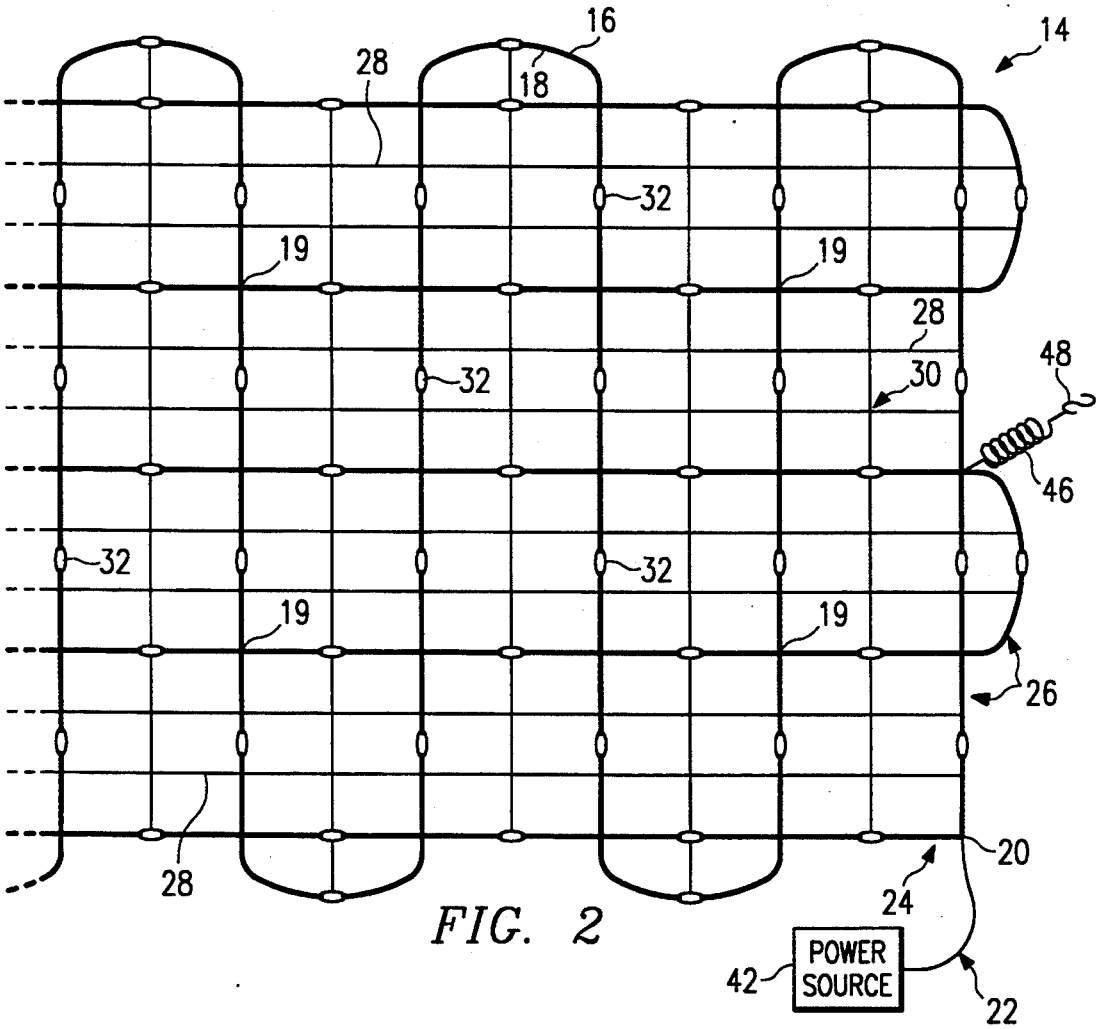
FIG. 2 is an outward plan view of the decorative lighting system shown in FIG. 1.

Referring now to FIG. 2, decorative lighting system 14 includes a first flexible insulated electrically conductive continuous wire 16 and a second flexible insulated electrically conductive continuous wire 18. Wires 16 and 18 are disposed adjacent to one another along their entire lengths.

Wires 16 and 18 are adapted at their first ends 22 to be electrically coupled to an electrical power source 42. Electrical power source 42 may be conventional house current, a portable battery pack, or any other suitable device to supply power to decorative lighting system 14. Wires 16 and 18, extend from power source 42 in coupled fashion to form a substantially planar serpentine pattern. The serpentine pattern is formed by crossing wires 16 and 18 upon themselves at spaced crossing points 19. At the final crossing point 20 a substantially planar web-like configuration 26 is completely formed from the serpentine pattern of overlapping wires 16 and 18. In one embodiment, second ends 24 of wires 16 and 18 may be fastened to their first ends 22 to complete the web-like configuration 26.

Figure 3:
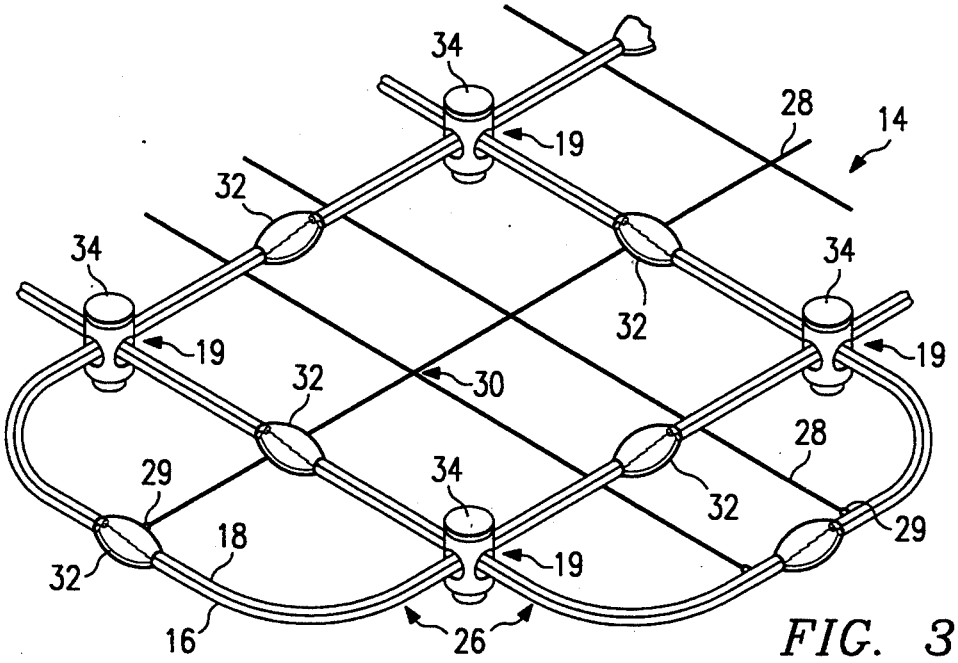
FIG. 3 is a fragmented enlarged perspective view of the decorative lighting system of FIG. 2 showing multi-directional barrel-lock connectors at the crossing points of the conductive wires.

As shown in detail in FIG. 3, the overlapping portions of wires 16 and 18 are adjustably fastened together at crossing points 19 using connectors 34. Connectors 34 depicted in FIG. 3 are conventional multi-directional barrel-lock connectors, but any suitable connector capable of adjustably fastening wires 16 and 18 may be used. Connectors 34 permit portions of wires 16 and 18 of web-like configuration 26 to be adjustably fixed with respect to one another, such that web-like configuration 26 may be easily modified to create variable light distribution patterns as desired.

Intersecting strands 28 of a flexible non-conductive material form netting 30. Netting 30 is attached to web-like configuration 26, and may be oriented along the same axes as web-like configuration 26, as shown in FIGS. 2 and 3, or rotated by a predetermined angle with respect to the axes of web-like configuration 26. Strands 28 of netting 30 may be coupled to web-like configuration 26 by a suitable fastener 29 (FIG. 3), by integrally weaving strands 28 into web-like configuration 26, or by a combination of fasteners 29 and weaving. In one embodiment, strands 28 may travel between wires 16 and 18. In another embodiment, strands 28 may travel alternately above and below sections of wires 16 and 18 to produce netting 30 integrally weaved into web-like configuration 26.

Displaced at intervals along wires 16 and 18 are conventional electrical lighting elements 32. It should be understood that the present invention contemplates placement of one or more lights between crossing points 19 of web-like configuration 26. Furthermore, the relative spacing of lighting elements 32 and crossing points 19 may be regular over web-like configuration 26 or variable to produce a desired lighting density and pattern.

As shown in detail in FIG. 4, each lighting element 32 comprises filament 36 electrically connected at its first end 37 to a non-insulated portion 38 of wire 16 and at its second end 39 to a non-insulated portion 40 of wire 18. Non-insulated portions 38 and 40 are shown to extend the length of lighting element 32 with a substantially constant cross-section. The present invention, however, contemplates any combination of support posts, reduced cross-section wires, or other suitable connectors to couple filament 36 across the potential supplied by wires 16 and 18. Furthermore, one or more filaments 36 may be coupled to wires 16 and 18 in any suitable manner or arrangement to form lighting element 32. Although FIG. 4 illustrates a parallel. circuit implementation, the present invention contemplates any suitable circuit in parallel or series that can deliver a potential to filaments 36 over one or more wires 16 and 18.

Filament 36 is enclosed in encasement 44, which may be colored or textured to alter the characteristics of the light emitted by filament 36. In one embodiment, encasement 44 may be formed to minimize projection out of the plane of the substantially planar decorative lighting system 14. For example, encasement 44 may have a long axis and a short axis with the long axis aligned parallel to conductive wires 16 and 18. Such a low profile lighting element 32 with encasement 44, as shown in FIG. 4, eliminates or substantially reduces entanglement of decorative lighting system 14. Although a specific lighting element 32 has been described, the present invention contemplates any suitable lighting element 32 that can be connected to wires 16 and 18.

When electrical power source 42 is activated, electricity flows into decorative lighting system 14 and lighting elements 32 emit light having characteristics determined by filaments 36 and encasements 44. Additional control wires (not shown) may be used to selectively illuminate individual or groups of lighting elements 32 without departing from the scope of the present invention.

As indicated in FIG. 2, netting 30 and web-like configuration 26 may be substantially coextensive in coverage. In one embodiment, netting 30 and web-like configuration 26 may assume a substantially rectangular shape which is significantly longer along a first axis than along a second axis perpendicular to the first axis. Preferably, cord 46 is fixedly or adjustably attached to extend along the first axis and provides a conventional hook 48 securedly attached at its axially distal end. Decorative lighting system 14 may then be rolled along the first axis and bundled into a compact package by cord 46 and hook 48.

Figure 5:
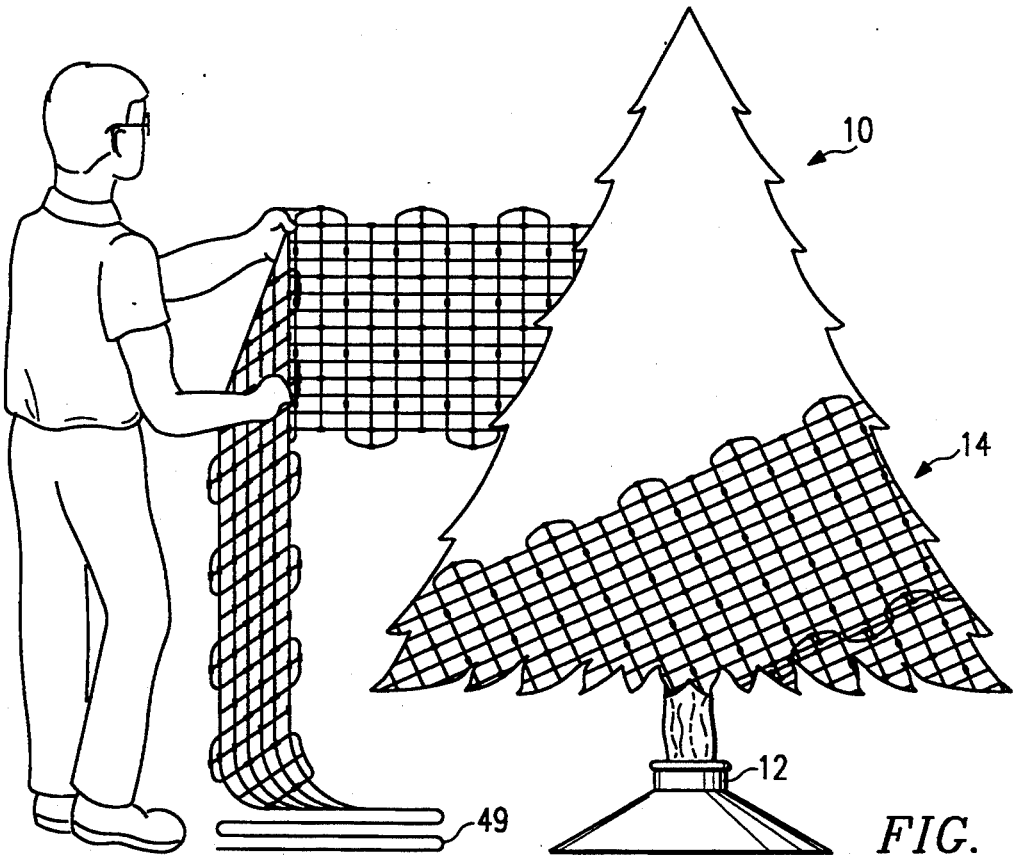
FIG. 5 is a pictorial view showing a method of decorating a Christmas tree in accordance with the present invention.

As shown in FIG. 5, such a decorative lighting system 14 may be removably and adjustably wrapped around the circumference of Christmas tree 10 a plurality of times to provide a desired pattern and distribution of lighting elements 32. Upon removal from Christmas tree 10, decorative lighting system 14 may be rolled up into a coil or bundle 49 and bound with cord 46 and hook 48 to facilitate compact transport and storage during periods of non-use.

Figure 6:
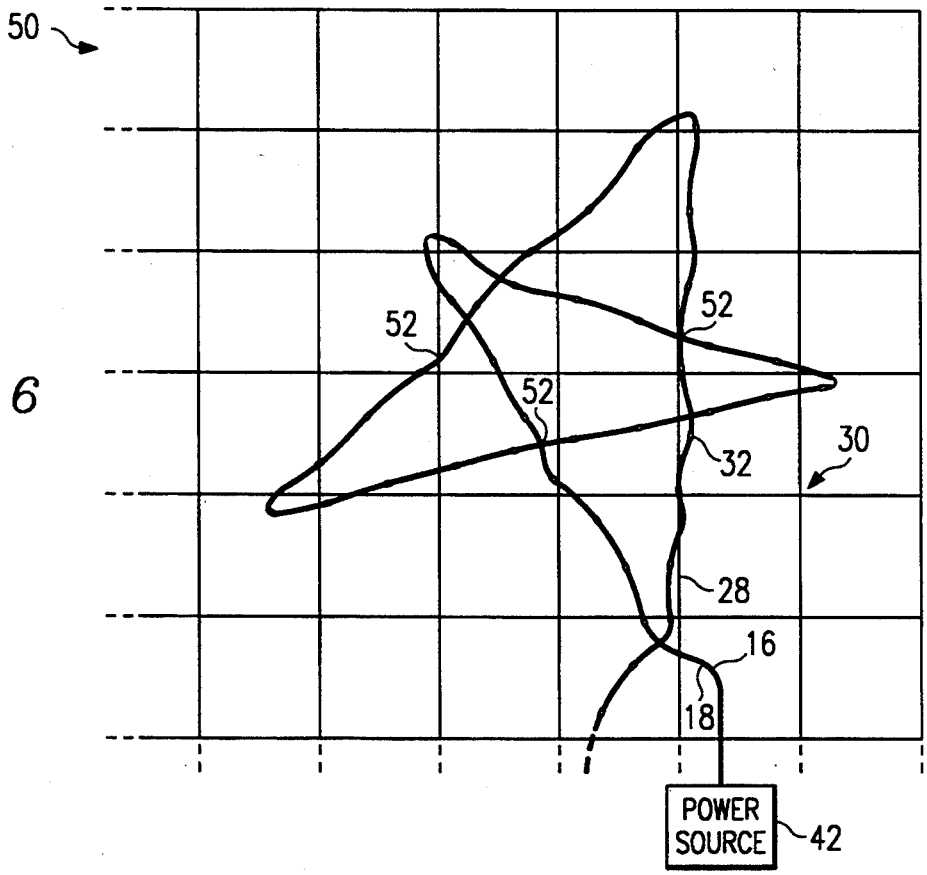
FIG. 6 is a top plan view of a decorative lighting system in accordance with another aspect of the present invention.

FIG. 6 illustrates another embodiment of a decorative lighting system 50 that can be configured to produce a wide variety of light patterns. Like the embodiment shown in FIG. 2, wires 16 and 18 are disposed adjacent one another and electrically connected to power source 42. Displaced at intervals along coupled wires 16 and 18 are conventional electrical lighting elements 32 connected in parallel between wires 16 and 18. Wires 16 and 18 are removably and adjustably wound over, around, through, and about the interstices of netting 30 to form a desired pattern of lighting elements 32. Wires 16 and 18 may be removably and adjustably secured to one another by conventional fasteners 52 where wires 16 and 18 intersect themselves or strands 28 of netting 30.

As illustrated by the star pattern in FIG. 6, decorative lighting system 50 can be configured into a variety of light patterns. For example, lighting elements may be configured to display various shapes, letters, numbers, or other desirable patterns.

Netting 30 may assume a substantially rectangular shape which is significantly longer along a first axis than along a second axis perpendicular to the first axis. In such a configuration, shown in FIG. 5, decorative lighting system 50 may be removably and adjustably wrapped around the circumference of Christmas tree 10 a plurality of times to provide a desired decorative appearance and to better secure decorative lighting system 50 to Christmas tree 10 during use. Furthermore, an elongate decorative lighting system 50 would provide an effective tablet to display messages in lights.

Although the present invention has been described in detail, it should be understood that various changes, substitutions and alterations can be made hereto without departing from the spirit and scope of the invention as defined by the appended claims.

What is claimed is:

1. A decorative lighting system for arranging an array of electrical lighting elements, comprising:

a plurality of electrically conductive filaments having first and second ends, each electrical lighting element having at least one filament, the filaments operable to emit visible electromagnetic radiation when an electric current is passed between the first and second ends;

a first flexible insulated electrically conductive wire having first and second ends, the first conductive wire electrically coupled at spaced intervals along its length to the first ends of the filaments;

a second flexible insulated electrically conductive wire having first and second ends, the second conductive wire disposed adjacent the first conductive wire along its length, the second conductive wire electrically coupled at spaced intervals along its length to the second ends of the filaments to form a parallel electrical circuit between the conductive wires;

the first ends of the conductive wires adapted to receive a potential from an electrical power source;

a plurality of connectors; and the first and second conductive wires extending from their first ends to form a substantially planar serpentine pattern with the conductive wires intersecting themselves at spaced crossing points, the conductive wires adjustably connected at the crossing points by the connectors so as to provide an adjustable substantially planar web-like configuration.

2. The system of claim 1, further comprising:

a netting of unitary construction formed by the intersection of stands of non-conductive flexible material; and a plurality of fasteners to couple the netting to the web-like configuration.

3. The system of claim 2, wherein the netting and the web-like configuration are substantially coextensive in coverage and form a rectangular decorative lighting system longer along a first axis than along a second axis perpendicular to the first axis, the decorative lighting system operable to removably and adjustably wrap around the circumference of a Christmas tree a plurality of times to provide a selected distribution of the electrical lighting elements.

4. The system of claim 3, further comprising:

a cord attached on one end to the decorative lighting system and extending along the first axis; and a hook securedly attached to another end of the cord and operable to secure the decorative lighting system into a coil to facilitate storage and transport.

5. The system of claim 1, wherein the connectors are multi-directional barrel-lock connectors.

6. The system of claim 1, wherein each electrical lighting element has an associated encasement covering at least one filament, the encasement having a long axis and a short axis, the long axis aligned parallel to the conductive wires and forming a low profile for the lighting element.

7. A decorative lighting system for arranging a plurality of electrical lighting elements, comprising:

a plurality of electrically conductive filaments, each of said plurality of filaments having first and second ends, each electrical lighting element having at least one filament, the filaments operable to emit visible electromagnetic radiation when an electric current is passed between the first and second ends;

a first flexible insulated electrically conductive wire having first and second ends, the first conductive wire electrically coupled at spaced intervals along its length to the first ends of the filaments;

a second flexible insulated electrically conductive wire having first and second ends, the second conductive wire disposed adjacent and coupled with the first conductive wire along its length, the second conductive wire electrically coupled at spaced intervals along its length to the second ends of the filaments to form a parallel electrical circuit between the conductive wires;

the first ends of the conductive wires adapted to receive a potential from a electrical power source;

a netting of unitary construction, formed by the intersection of strands of non-conductive flexible material; and a plurality of fasteners to couple the conductive wires to the netting.

8. The system of claim 7, wherein the netting and the conductive wires are substantially coextensive in coverage and form a rectangular decorative lighting system longer along a first axis than along a second axis perpendicular to the first axis, the decorative lighting system operable to removably and adjustably wrap around the circumference of a Christmas tree a plurality of times to provide a selected distribution of the electrical lighting elements.

9. The system of claim 8, further comprising:

a cord attached on one end to the decorative lighting system and extending along the first axis; and a hook securedly attached to another end of the cord and operable to secure the decorative lighting system into a coil to facilitate storage and transport.

10. The system of claim 7, wherein each electrical lighting element has an associated encasement covering at least one filament, the encasement extending radially and symmetrically around the conductive wires.

11. A method for decorating a Christmas tree, comprising:

forming a web-like configuration having first and second flexible insulated electrically conductive wires and a plurality of electrically conductive filaments having first and second ends, the step of forming a web-like configuration comprising:

electrically coupling the first conductive wire at spaced intervals along its length to first ends of the filaments;

electrically coupling the second conductive wire at spaced intervals along its length to second ends of the filaments to form a parallel electrical circuit between the conductive wires;

adapting the first ends of the conductive wires to receive a potential from an electrical power source;

arranging the conductive wires in a substantially planar serpentine pattern, the serpentine pattern resulting in intersections of the conductive wires upon themselves at spaced crossing points; and adjustably connecting the conductive wires at the crossing points by connectors to provide an adjustable substantially planar web-like configuration;

forming a netting of unitary construction by intersecting strands of non-conductive flexible material;

removably and adjustably fastening the netting to the web-like configuration to form a rectangular decorative lighting system longer along a first axis than along a second axis perpendicular to the first axis; and removably and adjustably wrapping the decorative lighting system around the circumference of the Christmas tree a plurality of times to provide a desired filament density and pattern.

12. The method of claim 11, further comprising:

removing the decorative lighting system from the Christmas tree;

rolling the decorative lighting system into a coil; and securing the coil to facilitate storage and transport.

* * * * *